United States Patent [19]

Lonberger

[11] Patent Number: 4,825,481

[45] Date of Patent: May 2, 1989

[54] SHOWER CURTAIN FASTENING ARRANGEMENT

[76] Inventor: Jeffery D. Lonberger, 6610 Sundown Dr., North, Indianapolis, Ind. 46240

[21] Appl. No.: 719,572

[22] Filed: Apr. 3, 1985

[51] Int. Cl.[4] ..... A47K 3/72

[52] U.S. Cl. ..... 4/608; 160/DIG. 6

[58] Field of Search ..... 4/608–610; 160/124, 330, 349.1, 349.2, DIG. 6

[56] References Cited

U.S. PATENT DOCUMENTS 2,303,502 12/1942 Rous ..... 4/608 X 4,077,072 3/1978 Dezura ..... 4/608 X

*Primary Examiner*—Charles E. Phillips

*Attorney, Agent, or Firm*—Warren D. Flackbert

[57] ABSTRACT

An arrangement for placing a shower curtain within the opening to a combination shower-bathtub enclosure which utilizes clamps, secured to the side or end walls of the enclosure, for the selective gripping of the free edges of the shower curtain when the latter is in a use condition. The preceding prevents unwanted water spray passage into the area outside of the enclosure and, thereby, overcomes a problem which has been commonly encountered heretofore. The clamps, spring-urged to a normally gripping relationship, serve convenience in use.

2 Claims, 1 Drawing Sheet

SHOWER CURTAIN FASTENING ARRANGEMENT

As is known, a common problem encountered during use of a combination shower-bathtub is the passage of water spray from space between the side edges of the shower curtain and the side or end walls of the bathtub enclosure and onto the surrounding area. While mechanical water channeling or diverting units are available, such are mainly ineffective in end results. In any event, the unwanted water flow oftentimes causes structural problems around the bathtub and, in the instance of a carpeted floor, for example, creates a dampness or sogginess which sometimes proves difficult to readily correct.

The invention overcomes the preceding difficulty by presenting a shower curtain fastening or clamping arrangement, i.e. two or more clamps, mounted on each of the end walls of the bathtub enclosure, proximate the free edges of the shower curtain and in a selective clamping/fastening relationship with such. In other words, provision is made for eliminating any unwanted space or gap between the shower curtain and the enclosure walls, and, thereby, any water spray passage. Basically, the invention may be defined as conventional clamp structures, spring-urged to a closed position, and adhesively positioned at the desired wall locations.

Figure 1:
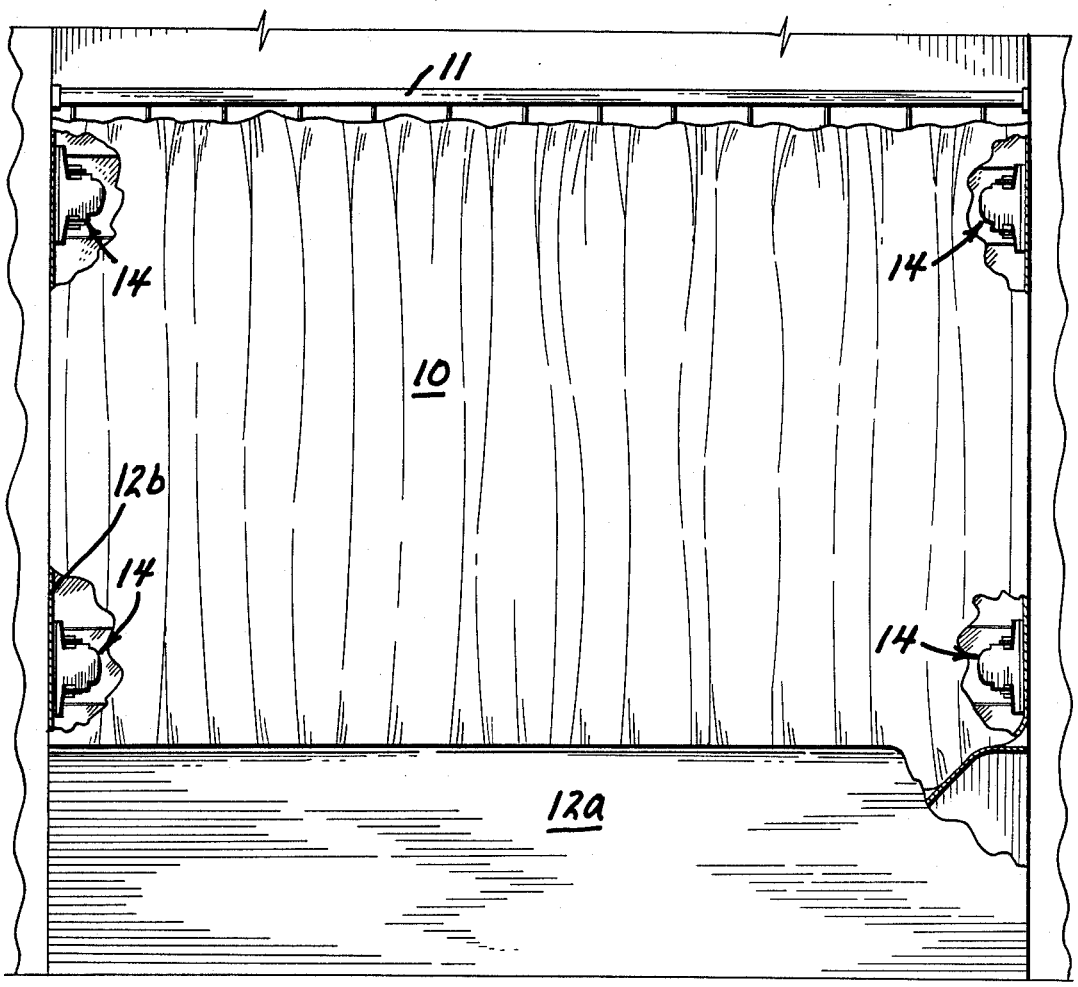
Figure 2:
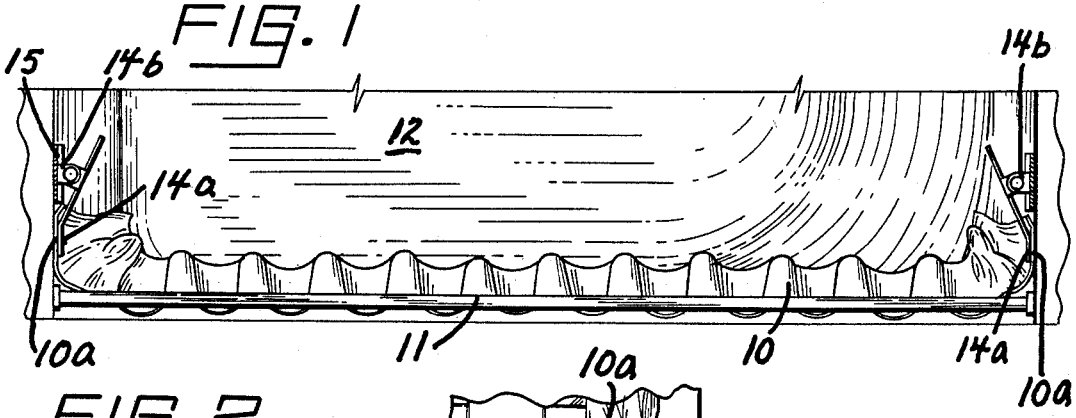
Figure 3:
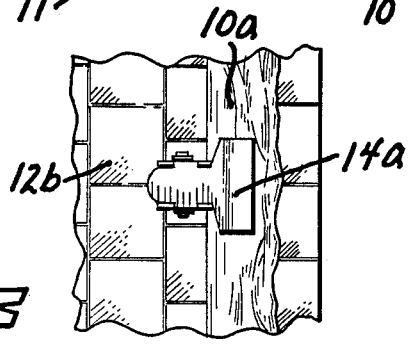

A better understanding of the present invention will become more apparent from the following description, taken in conjunction with the accompanying drawing, wherein FIG. 1 is a view in front elevation, partly fragmentary and partly in section, showing a shower curtain fastening or clamping arrangement in accordance with the teachings of the present invention;

FIG. 2 is a top plan view of a typical installation, looking downwardly on FIG. 1; and, FIG. 3 is a view in side elevation, looking from right to left in FIG. 2, further detailing the invention.

For the purposes of promoting an understanding of the principles of the invention, reference will now be made to the embodiment illustrated in the drawing and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the figures, the shower curtain clamping arrangement of the invention is shown in a typical use condition, i.e. shower curtain 10, slidable on rod 11, is positioned at the front of a shower-bathtub combination enclosure, the latter including bathtub 12 with front wall 12*a* and enclosure end or side walls 12*b*.

Clamps 14, typically secured by an adhesive 15 to enclosure end walls 12*b*, are arranged vertically and proximate free side edges 10*a* of the shower curtain 10. The clamps 14, generally conventional in form, each include an enlarged or flared mouth or gripping portion 14*a* (for optimum surface gripping contact) pivotal on a base 14*b* and spring-urged (not detailed) into a normally clamping condition. While two clamps 14 are illustrated on each side of shower curtain 10 in the presented installation, the number actually utilized is arbitrary.

In any event, and as particularly evident in FIGS. 2 and 3, and when used, clamps 14 are each pressed into a shower curtain receiving condition, i.e. gripping portion 14*a* and base 14*b* are spaced apart against the force of the spring. The edge 10*a* of the shower curtain 10 is then introduced for retaining purposes upon release and normal spring action. After all fastening/clamping is accomplished, the shower curtain 10 is in a position which eliminates any space or gap between such and the enclosure end walls 12*b*, i.e. the edges 10*a* are either between each gripping portion 14*a* and an end wall 12*b* or between the gripping portion 14*a*-base 14*b* (not shown). Since the bottom portion of shower curtain 10 is normally within the bathtub 12, i.e. behind front wall 12*a* thereof, during showering, water spray containment is totally and effectively achieved.

From the preceding, it should be evident that the invention affords positive shower curtain placement, and yet accomplishes positioning, for use or release, in a convenient manner. The water spray sealing results overcome the aforementioned problems occuring prior to the arrangement presented herein, where the latter is susceptible to various changes within the spirit of the invention, including, by way of example, the configuration and/or operation of the particular clamp employed; clamp placement, both position and number; and, the like. Thus, the preceding description should be considered illustrative and not as limiting the scope of the following claims:

I claim:

1. In combination with an enclosure for a combination shower-bathtub having walls and a shower curtain disposed across the entry to the enclosure, a shower curtain fastening arrangement comprising clamps disposed on said walls of said enclosure in a selective gripping relationship with free side edges of said shower curtain, where said clamps are each defined by a base portion secured to a wall of said enclosure and an enlarged shower curtain edge gripping portion extending away from the sides of said base portion and forwardly of the front of said base portion in the direction of entry to said enclosure, and where said base portion and said enlarged shower curtain edge gripping portion of each of said clamps are normally spring-urged to maintain a free edge of said shower curtain in direct contact with an adjacent wall.

2. The combination of claim 1 where said base portion of each of said clamps is adhesively secured to said wall of said enclosure.

* * * * *